US007963890B2

(12) United States Patent
Webber et al.

(10) Patent No.: US 7,963,890 B2
(45) Date of Patent: Jun. 21, 2011

(54) EXERCISE MACHINE WITH PIVOTING USER SUPPORT AND MULTIPLE CAM LINKAGE

(75) Inventors: Randall T. Webber, La Jolla, CA (US); Christopher E. Brennan, Santee, CA (US); Bruce Hockridge, San Diego, CA (US); Jeffrey O. Meredith, San Diego, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 382 days.

(21) Appl. No.: 12/058,038

(22) Filed: Mar. 28, 2008

(65) Prior Publication Data

US 2008/0214367 A1 Sep. 4, 2008

Related U.S. Application Data

(62) Division of application No. 10/633,805, filed on Aug. 4, 2003, now Pat. No. 7,594,880.

(51) Int. Cl.
*A63B 21/00* (2006.01)

(52) U.S. Cl. ..... 482/72; 482/100; 482/95

(58) Field of Classification Search ..... 482/130, 482/140, 142, 100, 137, 102, 103, 104, 95, 482/96, 72

See application file for complete search history.

(56) References Cited

U.S. PATENT DOCUMENTS

| | | | |
|---|---|---|---|
| 2,145,940 | A | 2/1939 | Marlowe |
| 4,441,708 | A | 4/1984 | Brentham |
| 4,478,411 | A | 10/1984 | Baldwin |
| 4,511,137 | A | 4/1985 | Jones |
| 4,641,833 | A | 2/1987 | Trethewey |
| 4,743,010 | A | 5/1988 | Geraci |
| 4,822,038 | A | 4/1989 | Maag |
| 4,844,456 | A | 7/1989 | Habing et al. |
| 4,944,641 | A | 7/1990 | Alves |
| 4,949,958 | A | 8/1990 | Richey |
| 5,254,067 | A | 10/1993 | Habing et al. |

(Continued)

FOREIGN PATENT DOCUMENTS

| | | |
|---|---|---|
| CA | 2075331 | 2/1994 |

OTHER PUBLICATIONS

V-Bench Leg Curl, Maxicam and Leg Extension, Mexicam, Muscle Dynamics Brochure, date unknown.

(Continued)

*Primary Examiner* — Jerome W Donnelly

(74) *Attorney, Agent, or Firm* — Procopio, Cory, Hargreaves & Savitch LLP

(57) ABSTRACT

An exercise machine has a main frame and a user support frame pivotally mounted relative to the main frame for rotation about a user support pivot axis between start and end positions. The user support frame has at least a primary support and a secondary support for supporting spaced positions on a user's body throughout an exercise movement. A user engagement device is movably mounted relative to the frames for engagement by the user in performing exercises, and an at least partially flexible connecting linkage translates movement of the user engagement device to rotational movement of the user support frame. The connecting linkage includes at least two axially spaced winding portions mounted for rotation about a common cam axis. A load resists movement of at least one of the user support, user engagement device, and connecting linkage.

25 Claims, 11 Drawing Sheets

U.S. PATENT DOCUMENTS 5,330,404 A 7/1994 Lopeleguy et al.
5,330,405 A 7/1994 Habing et al.
5,342,270 A 8/1994 Jones
5,352,171 A 10/1994 Lin
5,354,248 A 10/1994 Rawls et al.
5,356,358 A 10/1994 Chen
D357,041 S 4/1995 McBride et al.
5,417,634 A 5/1995 Habing
5,478,298 A 12/1995 Chen
5,520,599 A 5/1996 Chen
5,527,243 A 6/1996 Chen
5,527,250 A 6/1996 Chen
5,533,953 A 7/1996 Lui et al.
D372,509 S 8/1996 Yang
5,547,444 A 8/1996 Huang
5,573,482 A 11/1996 Wang et al.
5,580,340 A 12/1996 Yu
5,582,563 A 12/1996 Fan
5,616,105 A 4/1997 Wang et al.
5,620,402 A 4/1997 Simonson
5,626,542 A 5/1997 Dalebout et al.
5,643,147 A 7/1997 Huang
5,669,865 A 9/1997 Gordon
5,674,161 A 10/1997 Lin
5,683,334 A 11/1997 Webber
5,720,695 A 2/1998 Eckmann
5,722,918 A 3/1998 Lee
5,810,698 A 9/1998 Hullett et al.
5,899,836 A 5/1999 Chen
5,938,570 A 8/1999 Maresh
5,944,641 A 8/1999 Habing
5,961,427 A 10/1999 Habing et al.
6,004,247 A 12/1999 Webber
6,135,930 A 10/2000 Kuo
6,142,914 A 11/2000 Crawford et al.
6,162,153 A 12/2000 Perez et al.
6,264,588 B1 7/2001 Ellis
6,312,366 B1 11/2001 Prusick
6,605,024 B2 8/2003 Stearns
6,752,748 B1 6/2004 Scotti
6,811,522 B1 11/2004 McQuinn
6,855,098 B2 2/2005 Reitz et al.
6,916,278 B2 7/2005 Webber
6,971,978 B2 12/2005 Hyder
7,052,444 B2 5/2006 Webber
7,052,446 B2 * 5/2006 Morris et al. ..... 482/100
7,070,545 B2 7/2006 Lull et al.
7,141,003 B2 11/2006 Wu
7,141,008 B2 11/2006 Krull et al.
7,220,221 B2 5/2007 Mosimann et al.
7,223,213 B2 5/2007 Golesh
7,229,389 B2 6/2007 Hong
7,322,906 B2 1/2008 Webber
7,331,911 B2 2/2008 Webber et al.
7,335,140 B2 2/2008 Webber et al.
7,361,125 B2 4/2008 Webber et al.
7,384,381 B2 6/2008 Webber et al.
7,468,024 B2 12/2008 Webber et al.
7,553,263 B2 * 6/2009 Webb et al. ..... 482/100
2002/0013199 A1 1/2002 Giannelli et al.
2002/0187879 A1 12/2002 Ball et al.
2003/0199362 A1 10/2003 Chamberlin
2006/0247107 A1 11/2006 Carter
2006/0276313 A1 12/2006 Hong
2007/0232462 A1 10/2007 Webber et al.
2007/0293377 A1 12/2007 Webber et al.
2007/0293378 A1 12/2007 Webber et al.
2008/0058176 A1 3/2008 Webber et al.
2008/0132389 A1 6/2008 Webber et al.
2008/0153677 A1 6/2008 Webber et al.
2008/0182732 A1 7/2008 Webber et al.
2008/0214365 A1 9/2008 Webber et al.
2008/0214367 A1 9/2008 Webber et al.
2008/0220950 A1 9/2008 Webber et al.
2008/0234110 A1 9/2008 Webber et al.
2008/0242517 A1 10/2008 Webber et al.
2008/0248929 A1 10/2008 Webber et al.

OTHER PUBLICATIONS

CL2501 Seated Shoulder Press and CI2301 Chest Press, Hoist Fitness Systems Brochure undated.

Hoist Fitness Systems CL2301 Chest Press, Manufacturing Drawing, Mar. 2001.

Hoist Fitness Systems CL2501 Seated Shoulder Press, Jul. 2000.

* cited by examiner

EXERCISE MACHINE WITH PIVOTING USER SUPPORT AND MULTIPLE CAM LINKAGE

RELATED APPLICATION

The present application is a Divisional of co-pending U.S. patent application Ser. No. 10/633,805 filed on Aug. 4, 2003, and is a Divisional of co-pending U.S. patent application Ser. No. 11/846,472 filed on Aug. 28, 2007, and the contents of both of the aforementioned co-pending applications are also incorporated herein by reference in their entirety.

BACKGROUND

1. Field of the Invention

This invention relates generally to exercise machines, and is particularly concerned with an exercise machine with a pivoting user support which has a multiple cam linkage system.

2. Related Art

Movable user supports linked to the movement of an exercise arm are extremely common in exercise machines, and are generally known as composite motion exercise machines. U.S. Pat. No. 2,252,156 of Bell and U.S. Pat. No. 6,251,047 of Stearns show bicycle and exercise bike designs in which a seat or user support is linked to an exercise arm or crank and pedal system to provide up and down movement to the seat. The most common application of movable user supports is found in rowing and horse riding type exercise machines, which use the weight of the user as the exercise resistance. In U.S. Pat. No. 3,446,503 of Lawton, U.S. Pat. No. 4,743,010 of Geraci, and U.S. Pat. No. 5,342,269 of Huang, a seat and exercise arm are pivotally mounted on the base frame, with the seat linked to the exercise arm for dependent movement. U.S. Pat. No. 4,300,760 of Bobroff, U.S. Pat. No. 5,299,997 of Chen, U.S. Pat. No. 5,356,357 of Wang, U.S. Pat. No. 5,453,066 of Richter, U.S. Pat. No. 5,458,553 of Wu, U.S. Pat. No. 5,503,608 of Chang and U.S. Pat. No. 5,507,710 of Chen all show horse riding type exercise machines. They all consist of a user support pivotally attached to a base frame, and one or more exercise arms pivotally connected to the frame and pivotally linked to the user support.

U.S. Pat. No. 6,264,588 of Ellis shows a composite motion movement machine that has a moving exercise arm linked to a movable user support, and a pivoting truck system which is slidably connected to rails mounted both on the main frame and user support. The movable user support and exercise arm are both pivoted at the same point on the base frame, in front of the user support. A belt connects the exercise arm to the truck. When the exercise arm is pushed or pulled, the belt pulls the truck along the rails, forcing the user support to rotate about its pivotal connection to the frame. This design puts all of the user's weight on one side of the pivot, producing a high initial lifting resistance when the user starts the exercise, and also has no means for properly aligning the exercise arm and user support during the exercise movement.

Movable seats linked to exercise arms have also been used in multi-purpose exercise machines, such as U.S. Pat. No. 5,330,405 of Habing, U.S. Pat. No. 5,334,120 of Rasmussen, U.S. Pat. No. 5,669,865 of Gordon, U.S. Pat. No. 5,733,232 of Hsu, and U.S. Pat. No. 6,244,995 of Prsala. In U.S. Pat. No. 5,330,405 of Habing, a lever arm is pivotally connected to the base frame and supports a movable sub-frame including a user support which is also pivotally connected to the stationary base frame. An exercise arm is pivotally mounted on the sub-frame and linked to the lever arm via cables and pulleys, so that movement of the exercise arm pulls the cables lifting the lever arm, and causing the sub-frame to pivot about its connection to the base frame and rise against the weight of the user. U.S. Pat. No. 5,733,232 of Hsu shows another multi-purpose exercise machine with a pivoting seat, but in this case the back pad is stationary and only the seat pad is pivoted. Thus, the seat travels in an arcuate path without any secondary stabilization for the user, forcing the user to try to maintain their balance on the seat as it arcs upward. Also, in this design, the pivot point for the seat is located at a spacing behind the user position, so that all of the user's weight will oppose the user when starting an exercise from rest. Neither of these machines has any capability for aligning the user and user support with a rigid exercise arm, and thus do not maintain or support the user in the proper position throughout the exercise.

Gordon shows a multi-purpose exercise machine that has a hinged, two-piece user support that folds and unfolds with each exercise repetition. The user support consists of a seat portion and a backrest portion, which are pivotally connected together. The user support is pivotally connected to a main frame, as is a first exercise arm. This first exercise arm provides pressing and pulldown exercises. A second exercise arm is pivotally connected to the user support for providing leg exercises. This second arm travels with the seat portion of the user support. A connecting link pivotally connects the first exercise arm with the user support so that movement in the arm forces movement in the user support. The link connects to the user support at the same pivot that joins the seat portion with the backrest portion. In a second embodiment a flexible line connects the user support with the main frame and has user-engaging handles attached to one end so that movement to the handles results in movement to the user support. In this design, the flexible line acts as both connecting link and exercise arm. In both designs, the seat and backrest do not travel in a fixed relationship to each other and additional support such a footrest, safety belts and thigh gripping surfaces are required to keep the user properly and safely positioned in the user support. Because most of the combined weight of the user and user support remain on one side of the user support's gravitational centerline, this weight is used as partial exercise resistance. Movement of the user support is designed to be an exercise of its own, rather than providing proper positioning/alignment of the user relative to the exercise arm. The folding and unfolding of the two-piece user support constantly works the abdominal and low back muscles, which means that these muscles are being worked even when other exercises are being performed. The user cannot truly isolate any one specific muscle or muscle group. The stomach cannot be worked without working the low back, the arms, chest, shoulders, upper back and legs all must be worked with one another or at the least with both the stomach and low back. Because of this the user cannot fully fatigue other muscles as the abdominals and low back would fatigue first.

Current exercise machines with pivoting or movable user supports often do not accurately maintain proper positioning of the user throughout the exercise motion, can result in awkward hand or wrist positions, and often involve exaggerated and unnatural arcing movements, or linear, non-arcing arm movements, rather than the smaller elliptical movement associated with free weight or natural exercise movements. There is no provision for proper positioning of the user relative to the position of the user engaging portion of the exercise arm throughout the entire exercise motion. Often, an awkward starting or finishing position is required, potentially causing strain or injury.

SUMMARY

Embodiments described herein provide for an exercise machine with a pivoting user support which has a multiple cam linkage which translates movement of an exercise arm or engagement device into movement of the user support.

An exercise machine in one embodiment comprises a floor engaging main frame, a user support frame pivotally associated with the main frame, a user engagement device movably mounted relative to the frames for actuating by a user in order to perform an exercise, and a connecting linkage which links movement of the user engagement device to movement of the user support. A load provides resistance to movement of the user support frame, user engagement device and/or connecting linkage. The connecting linkage and pivot mounts are arranged so that movement of the exercise arm results in self-aligning movement of the user support. The connecting linkage includes a dual cam or dual cam portions rotatable about a common cam axis, and at least one flexible link extending from a first cam or cam portion of the dual cam to the user support frame or user engagement device. In one embodiment, the first flexible link extends to the user support frame and a second flexible link extends from a second cam or cam portion of the dual cam to the user engagement device. The cam or cam portions may be of different profiles, and the flexible links may be secured to the respective cam or cam portions so that one link winds while the other unwinds during an exercise.

In one embodiment, each flexible link is a cable extending around one or more pulleys. The pulleys may include at least one pulley mounted on the main frame. The exercise machine may comprise an upper body machine such as a rear deltoid exercise machine, a mid row exercise machine, a pec fly exercise machine, a chest press machine, or the like. In another embodiment, the exercise machine comprises a leg exercise machine. The user engagement device may comprise one or more pivotally mounted exercise arms, or may be handles connected to one or more flexible members. In one embodiment, two exercise arms or handles may be movable in unison or independently. In one embodiment, the second flexible link comprises a first cable extending from the second cam or cam portion to a first pulley, and the user engagement device comprises handles associated with at least one additional cable linked to the first pulley.

The user support comprises primary and secondary supports which support spaced positions on a user's body throughout an exercise. In one embodiment, the primary support is a seat pad which is horizontal or slightly reclined in an exercise start position. The secondary support may comprise an upright support pad for the user's back or chest. Because the user support moves in conjunction with the exercise arm or user engagement device, the arcuate path of the exercise arm relative to the user support is reduced. The result is a more natural feeling exercise movement that more closely replicates the movement found in the corresponding free weight exercise.

In one embodiment, the user support pivot axis defines a vertical gravitational center line, and a portion of the combined weight of the user and user support frame is positioned on the movement side (i.e. the side the user support is pivoting towards) of the gravitational center line in the start position. This reduces the initial lifting resistance. By finishing the exercise with a portion of the combined user and user support weight on the trailing side of the center line in the movement direction, resistance "drop-off" at the end of an exercise is reduced. This distribution reduces the effect of the user's body weight on the resistance felt during the exercise. This is the opposite of most exercise devices that have moving user supports, which tend to rely on the weight of the user for resistance. Whether it is the starting or the finishing position, most prior art pivoting user supports place the majority of the user's weight on one or the other side of the pivoting mechanism's gravitational center line, resulting in either a high initial lifting resistance, or else a resistance "drop off" at the end of the exercise.

In one embodiment, the exercise arm or user engagement device is movably associated with a forward end of the user support frame at a first pivot connection, and the connecting linkage is associated with the user support frame at a second location. In another embodiment, the user engagement device and connecting linkage are both movably associated with the main frame. The user engagement device may be a bi-directional exercise arm.

The exercise resistance or load may comprise a weight stack, weight plates mounted on pegs, or other types of resistance such as hydraulic, pneumatic, electromagnetic, or elastic bands, and may be associated with any of the moving parts, i.e. the user support frame, exercise arm, or connecting linkage.

The multiple cam connecting linkage translates movement of the user engagement device to rotational movement of the user support frame. Actuation of the user engagement device causes the dual cam to rotate in a first direction to wind one of the flexible connecting links onto the respective cam portion, causing the user support frame to move.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for an exercise machine having an exercise arm or user engagement device and user support which travel in a dependent relationship. The exercise machines in the embodiments disclosed herein have a multiple cam connecting linkage incorporating at least two cam portions rotatable about a common cam axis and flexible connecting links associated with each cam portion. The connecting linkage translates movement of a user engagement device to movement of the user support, and is designed to provide a pivoting user support which automatically aligns with movement of the exercise arm or user engagement device and which provides appropriate positioning of the user throughout the entire exercise movement.

After reading this description it will become apparent to one skilled in the art how to implement the invention in various alternative embodiments and alternative applications. However, although various embodiments of the present invention will be described herein, it is understood that these embodiments are presented by way of example only, and not limitation.

Figure 1:
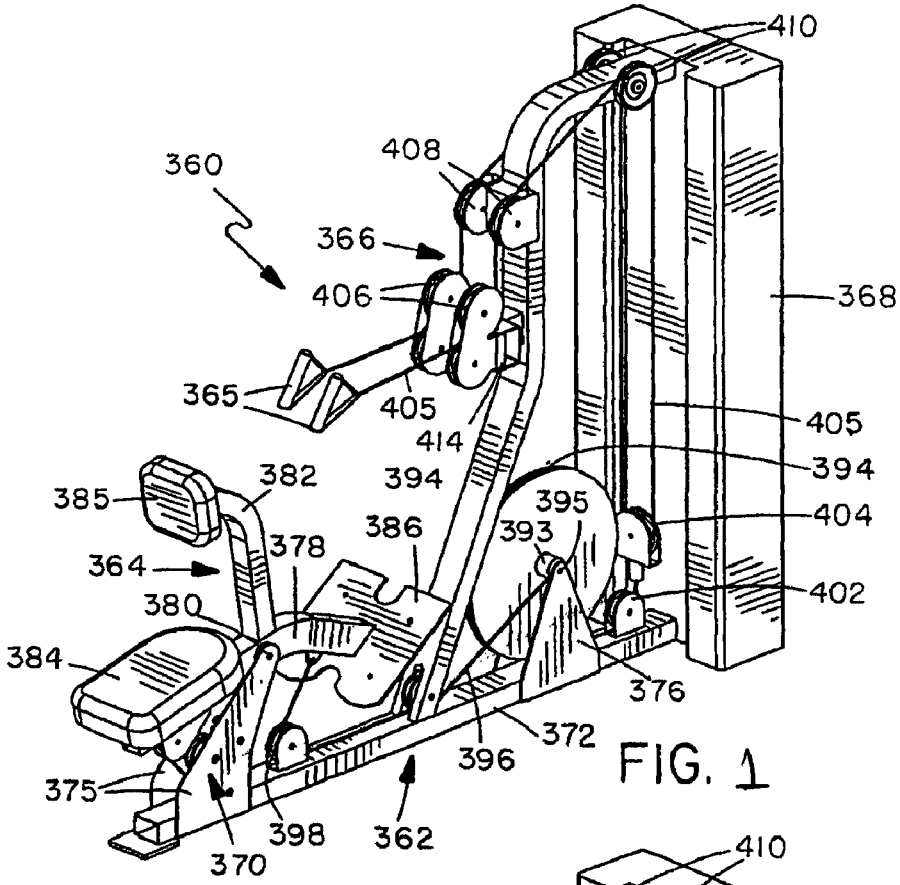
FIG. 1 is a front perspective view of an upper back exercise machine according to one embodiment, with the machine illustrated in a start position adopted at the beginning of an exercise movement.
Figure 2:
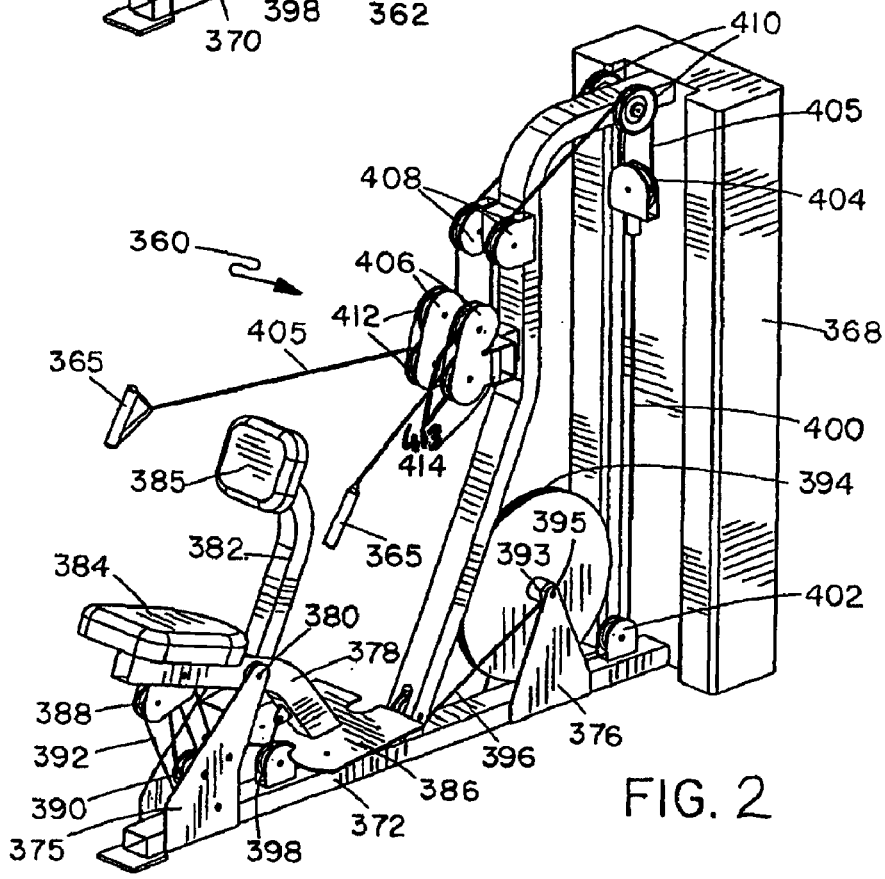
FIG. 2 is a front perspective view similar to FIG. 1, illustrating the machine in an exercise ending position.
Figure 3:
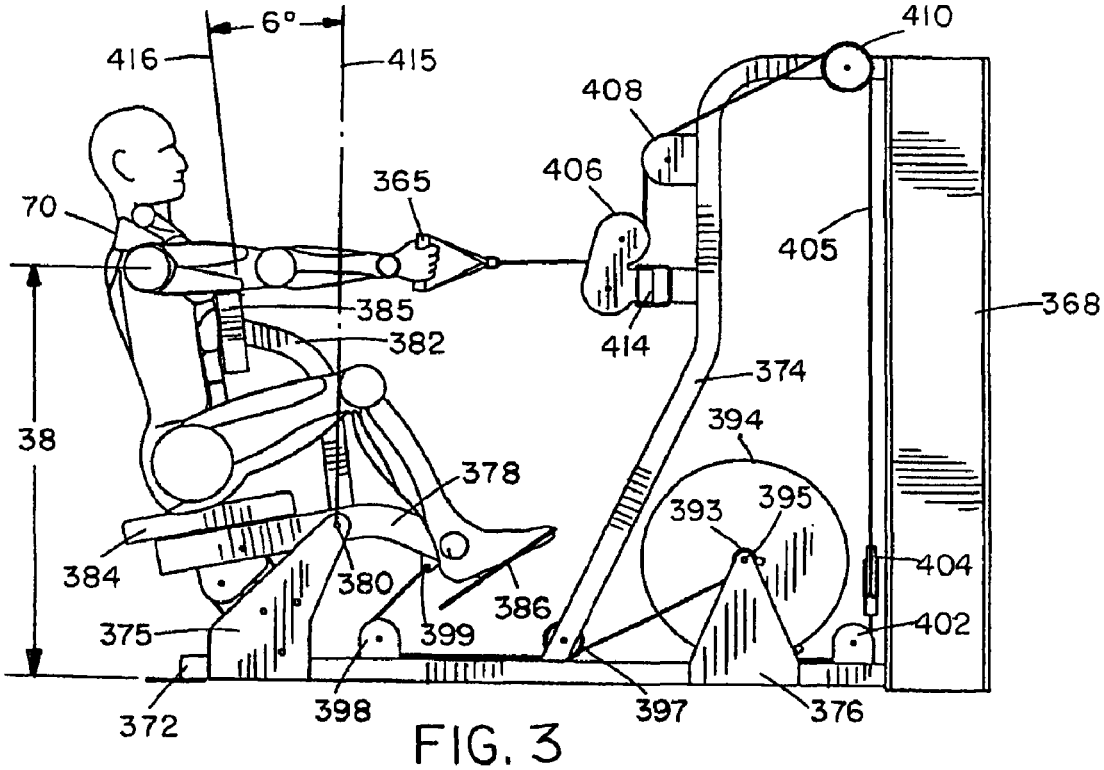
FIG. 3 is a side elevation view of the machine of FIGS. 1 and 2, with a user seated on the machine in the start position adopted at the beginning of the exercise.
Figure 4:
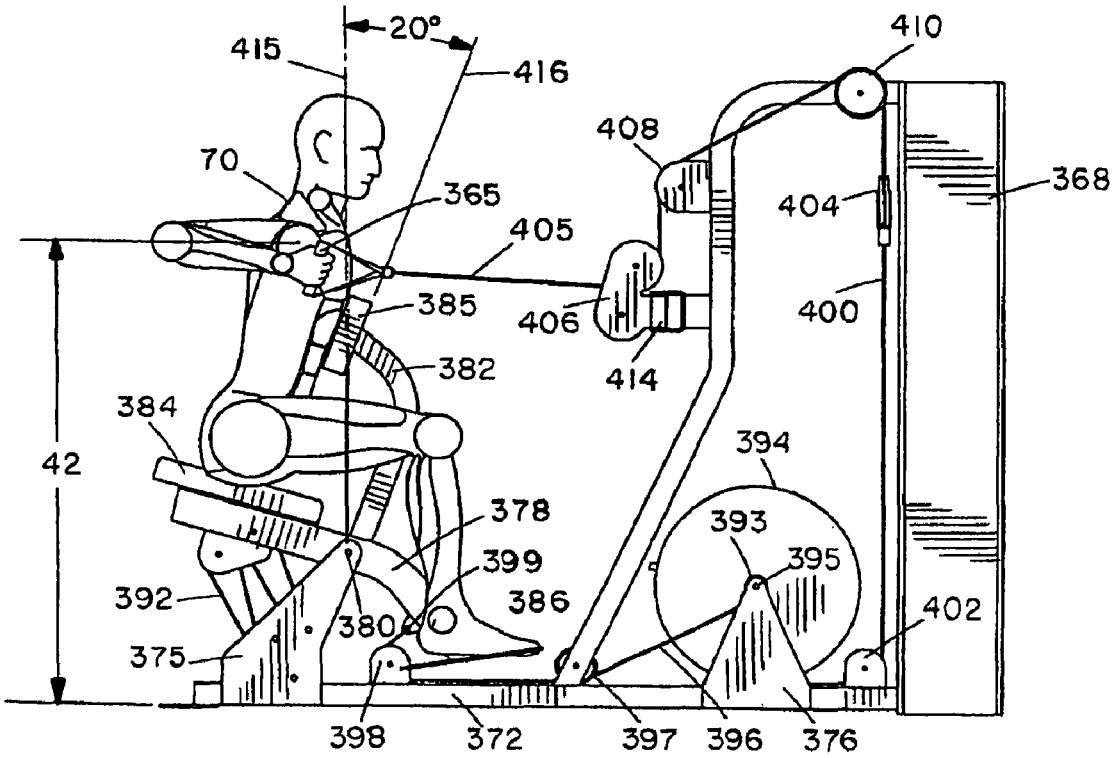
FIG. 4 is a side elevation view similar to FIG. 3, illustrating the user and machine in the end position of the exercise.

FIGS. 1 to 5 illustrate an upper back exercise machine 360 according to one embodiment. FIG. 1 illustrates the machine in a start position while FIG. 2 illustrates the machine in an end position for the exercise, with FIGS. 3 and 4 illustrating the same start and finish positions with a user seated on the machine.

The machine 360 has a main frame 362, a user support frame 364 pivotally mounted on the main frame, a user engagement device comprising user engaging handles 365 attached to opposite ends of a cable or flexible exercise arm member 405 extending around a series of pulleys in cable and pulley assembly 366, an exercise resistance comprising a weight stack in housing 368 linked to the user support frame via a second cable and pulley assembly 370, and a multiple cam connecting linkage extending from the user engagement device to the user support frame. In this embodiment, the multiple cam linkage comprises a dual cam assembly 393, 394 and first and second cables or flexible links 400, 396 extending between cable 405 and a forward end of the user support frame, as explained in more detail below. The flexible links 400, 396 may comprise any suitable flexible elongate members such as cables, belts, lines, chains and the like.

The main frame 362 comprises a horizontal base section 372, an upright section 374, user support pivot mount plates 375 extending upwardly at the rear end of the base section, and a pair of cam pivot mounting plates 376 extending upwardly from the base section between the upright section 374 and the weight stack housing 368.

The user support frame 364 is generally T-shaped, with a base 378 pivotally mounted between the upper ends of the pivot mount plates via pivot pin 380, and an upright post 382 which curves rearward at its upper end. A user support seat pad 384 is mounted on the rear part of the base, while a chest support pad 385 is mounted at the upper end of post 382. A foot support or footplate 386 is secured to the forward end of the base 378. The rear part of the base 378 is linked to the weight stack via the second cable and pulley assembly 370. As best illustrated in FIG. 2, cable and pulley assembly 370 comprises a set of pulleys 388 mounted on the undersurface of base 378, a set of pulleys 390 mounted between the pivot mounting plates 375, and a cable 392 extending from an anchor back and forth over the two sets of pulleys, and then running through the base 372 into the weight stack housing where it extends over further pulleys (not visible in the drawings) before linking in any conventional manner with the weight stack.

The forward end of the user support frame is linked to the user engaging handles via the connecting linkage 396, 393, 394, and 400, and the first cable and pulley assembly 366. The connecting linkage includes first and second cam portions 393,394 of different diameter or profile mounted on a pivot shaft 395 rotatably mounted between the upper ends of cam plates 376. The forward end of the user support base 378 is linked to the first, smaller cam 393 by a cable 396 extending from the cam around a pulley 397 at the lower end of upright 374, around a second pulley 398 on the frame base beneath the user support base, and tied off at anchor 399 on the underside of the base 378 close to the footplate 386.

A second cable 400 extends from the second, larger cam 394 around a fixed pulley 402 at the forward end of base 372 and is anchored to the housing of a floating pulley 404. As noted above, the user engagement device in this embodiment comprises the handles 365 and flexible cable 405 which has opposite ends secured to the respective handles 365. Cable 405 extends from one handle between pulleys 412 of one set of a pair of swivel pulley assemblies 406 mounted on upright 374, around one of a pair of fixed, side-by-side pulleys 408 on the upright above the swivel pulley assemblies 406, then around one of a pair of parallel pulleys 410 on opposite sides of an upper, generally horizontal portion of the upright 374, and then downwardly around the floating pulley 404. From the pulley 404, cable 405 extends back up around the second one of the pulleys 410, around the second one of the pulleys 408, and is then reeved between the two pulleys 413 in the second set of the swivel pulley assemblies 406, before connecting to the second handle 365. With this arrangement, rearward movement of one or both handles pulls up the floating pulley 404, rotating the cams 393,394. Cables 396 and 400 are oppositely connected to the respective cam portions 393 and 394 so that pulling on handles 365 unwinds cable 400 from cam portion 394 while winding cable 396 onto cam portion 393, rotating the user support frame upwardly about pivot 380.

Figure 5:
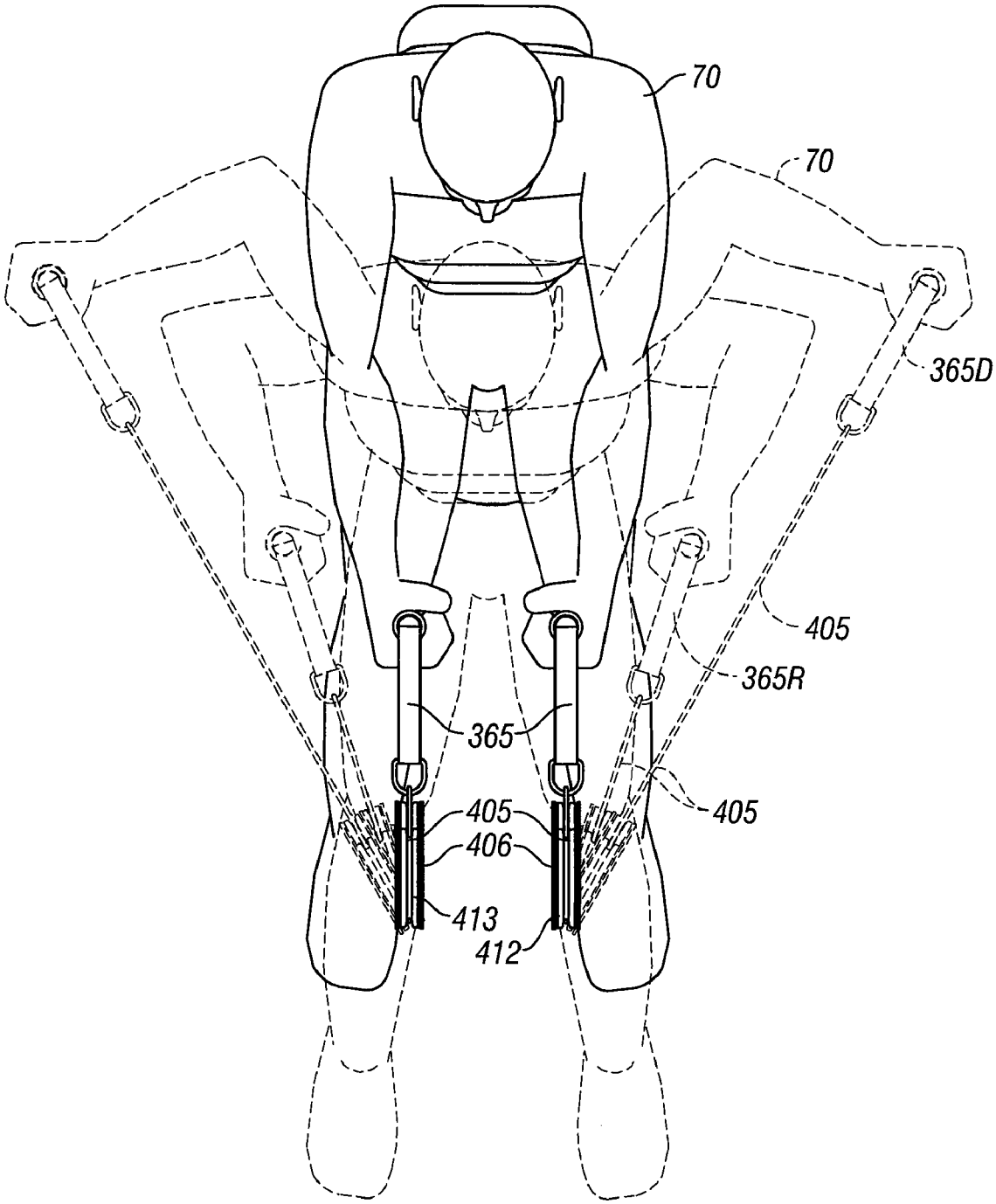
FIG. 5 is a top plan view of part of the user engaging handle part of the machine of FIGS. 1 to 4, with a seated user engaging the handles, illustrating user defined movement of the handles to perform different upper back exercises.

The swivel mounts 414 of the two swivel pulley assemblies 406 allow the assemblies to pivot in and out as indicated in FIG. 5 as the user moves their hands in an exercise movement which exercises the upper back muscles. This allows the user to control the exercise path, as indicated in FIG. 5 and described in more detail below. In order to perform the exercise, the user 70 first sits on the user support in the position of FIG. 3 and the solid line position of FIG. 5, placing their feet on the footplate 386, their chest against the chest pad 385, and grabs the handles 365 with their arms straight in front of their body, slightly bent, and their hands close together, as indicated in FIG. 3 and in solid lines in FIG. 5. At the start of the exercise, the user is in a slightly reclined orientation at an angle of around 6 degrees to the gravitational centerline 415 or vertical centerline of the user support pivot 380, as indicated in FIG. 3, where the second dotted line 416 indicates the orientation of the chest pad 385 or front of the user's chest.

From the position illustrated in FIG. 3, the user pulls the handles or hand grips 365 rearward. Since the exercise arm in this embodiment is a flexible cable 405 which extends from each handle between the pulleys of a respective set of swivel pulley assemblies 406 which can swivel inward and outward, the user controls the exercise path and thus the type of upper back exercise performed. In FIGS. 3 and 4, the user is shown performing a rear deltoid exercise in which the user moves their hands rearward and outward into an end position in which the user's arms are bent with their hands positioned out to the sides of their body, as illustrated in the outermost dotted line handle position 365D of FIG. 5. As noted above, this movement also pulls the user support upwardly against the exercise resistance, with the chest pad and user upper body ending up in a forward lean of around 20 degrees from the vertical. The user's arms finish in a bent position with their hands positioned out to the sides, slightly below and forward of their shoulders.

The user is in three different positions throughout the exercise, starting in a recline or decline position, traveling through a straight, upright position, and ending in a forward incline position. At the same time, there is a change in elevation of the user's shoulders between the start and finish position, which amounts to about a four inch change. Additionally, the user can determine the travel path of the user engaging handles or grips 365. These factors together provide an enhanced workout by involving a greater number of muscles than a rear deltoid exercise performed in only one position, thereby combining multiple exercises into one. Instead of performing a rear deltoid exercise, a user may chose to perform a mid-row type of exercise, pulling their hands back and only slightly outwards, with the handles or grips 365 ending in dotted line position 365R of FIG. 5. Since cable 400 is not pulled quite as far when the mid row exercise is performed, the end position of the user support for this exercise is slightly different from that of FIG. 4, and is at a slightly smaller forward inclination than that illustrated. The user may define the travel path of the grips as desired throughout the exercise and may end the exercise with the handles in either of the positions illustrated in FIG. 5, or in any other desired position.

The gravitational centerline or vertical centerline 415 of the user support pivot runs through the exerciser's thigh, just behind the knee in the start position and ending at mid thigh in the finish position of the rear deltoid exercise illustrated in FIGS. 3 and 4. When the user performs the mid-row exercise ending with the handles at position 365R of FIG. 5, the user and user support are positioned slightly to the rear of the position illustrated in FIG. 4 at the exercise finish or end position. In either case, there is a balanced distribution of weight on each side of the centerline 415 both at the start and end position, minimizing the effect that the weight of the exerciser and user support has on the exercise resistance. The amount of weight positioned on each side of centerline 415 varies only slightly from the start to the finish position. The combined weight of the user and user support has little effect on the amount of starting resistance because a substantially equal amount of weight is balanced rearward of the user support pivot. By the same token, because only a small portion of the user passes through the gravitational centerline during the exercise, there is no appreciable drop-off in resistance felt by the user.

In this embodiment, the user engagement device comprises handles attached to a flexible line or cable 405, to provide a unilateral, three dimensional user defined exercise motion. The machine is designed to mimic the natural elliptical movement of the corresponding free weight dumbbell exercise, but is able to combine the effectiveness of multiple exercises by rotating the user from reclined to flat to inclined positions throughout the exercise. The connecting linkage 396, 393, 394, 400 which translates movement of the user engagement device into movement of the user support frame is partially flexible and includes at least two axially spaced cams or cam portions rotatably mounted about the same cam axis 395, arranged so that one cable or flexible link wraps around one of the cam portions while the other unwraps. Pulling on the handles or grips 365 in this machine rotates the dual cam assembly in a first direction (anti-clockwise as viewed in FIGS. 3 and 4), unwinding cable 400 from the larger cam 394, while winding a smaller amount of cable onto the smaller cam 393. Cams or separate cam portions of different relative diameters can be selected in order to change the ratio between handle movement and user support frame movement, depending on the desired end position for the user support frame.

FIGS. 6 to 11 illustrate another embodiment of an exercise machine 250 which has a multiple cam connecting linkage and a bi-directional exercise arm. In this embodiment, the exercise machine 250 is a combination leg extension and leg curl machine, but different types of exercise machine may have a similar linkage in conjunction with a bi-directional exercise arm in other embodiments. This machine has an adjustable bidirectional exercise arm assembly to provide resistance for both leg extension and leg curl exercise movements. Machine 250 has a main frame on which a user support 258 is pivotally mounted, and a leg exercise arm assembly 290 is pivotally mounted at a forward end of the user support. In this embodiment, movement of the leg exercise arm is linked to movement of the user support by means of a flexible connecting linkage including a multiple cam assembly and flexible links extending from the assembly to the exercise arm and the user support, as explained in more detail below.

The main frame of machine 250 has a base section or tube 252 with end supports or feet 253 for engaging the floor and an inclined upright tube 254 located approximately at a mid position on the base section. A pivot mount or pivot bracket 255 is located approximate the top end of upright tube 254. A short upright post 257 is located at a forward end of base section 252. A transverse guide tube 256 for connecting to a selectorized weight stack (not illustrated) extends from the base section 252.

Figure 7:
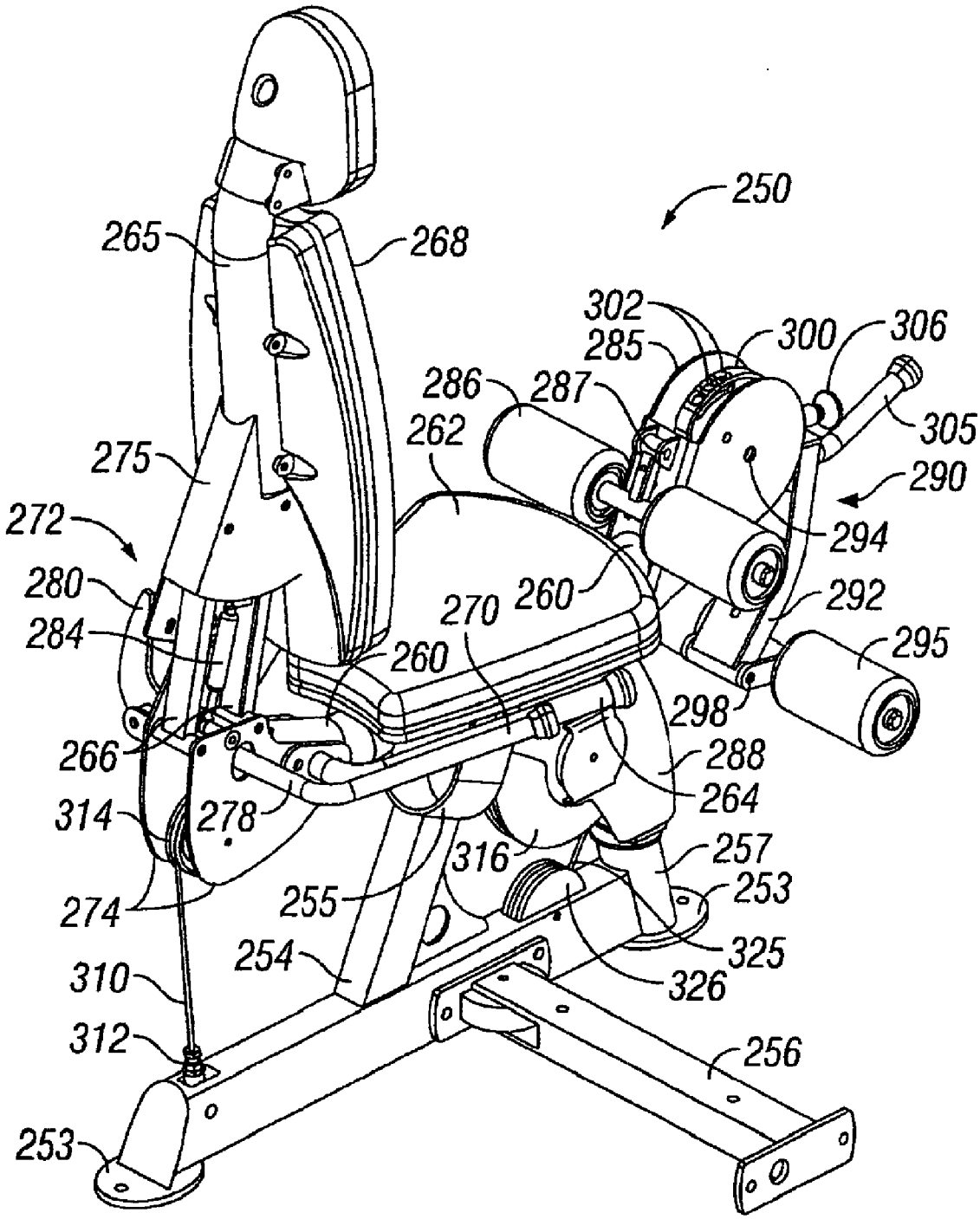
FIG. 7 is a rear perspective view of the machine of FIG. 6.
Figure 8:
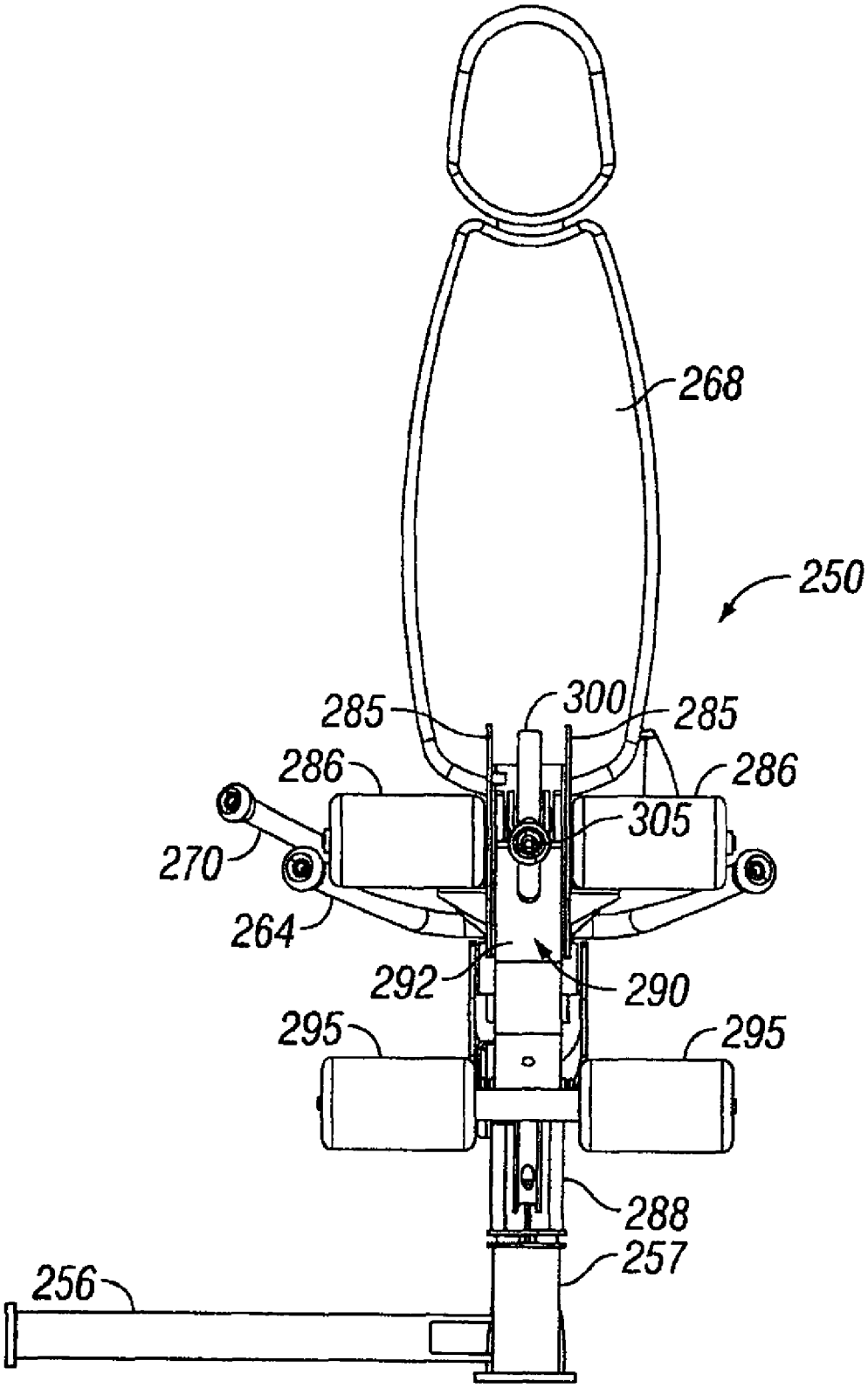
FIG. 8 is a front elevation view of the machine of FIGS. 5 to 7.
Figure 9:
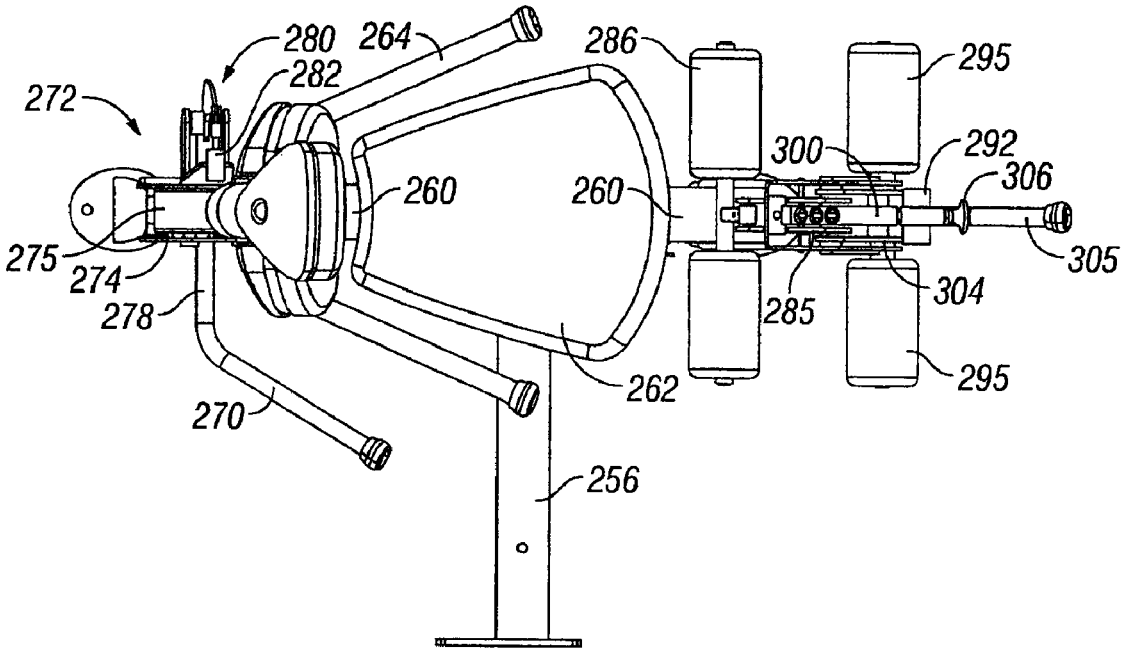
FIG. 9 is a top plan view of the machine of FIGS. 5 to 8.

The user support 258 has a seat frame having a seat support tube 260 with a seat pad 262 supported on top of the tube, and support handles 264 fixedly attached on opposite sides of the tube extending on opposite sides of the seat pad 262. A back rest frame 265 is adjustably mounted at the rear end of the seat support tube 260 via a four bar pivoting linkage system having a pair of linkage bars 266, as illustrated in FIG. 7. Back pad 268 is mounted in front of the back rest frame 265.

Figure 6:
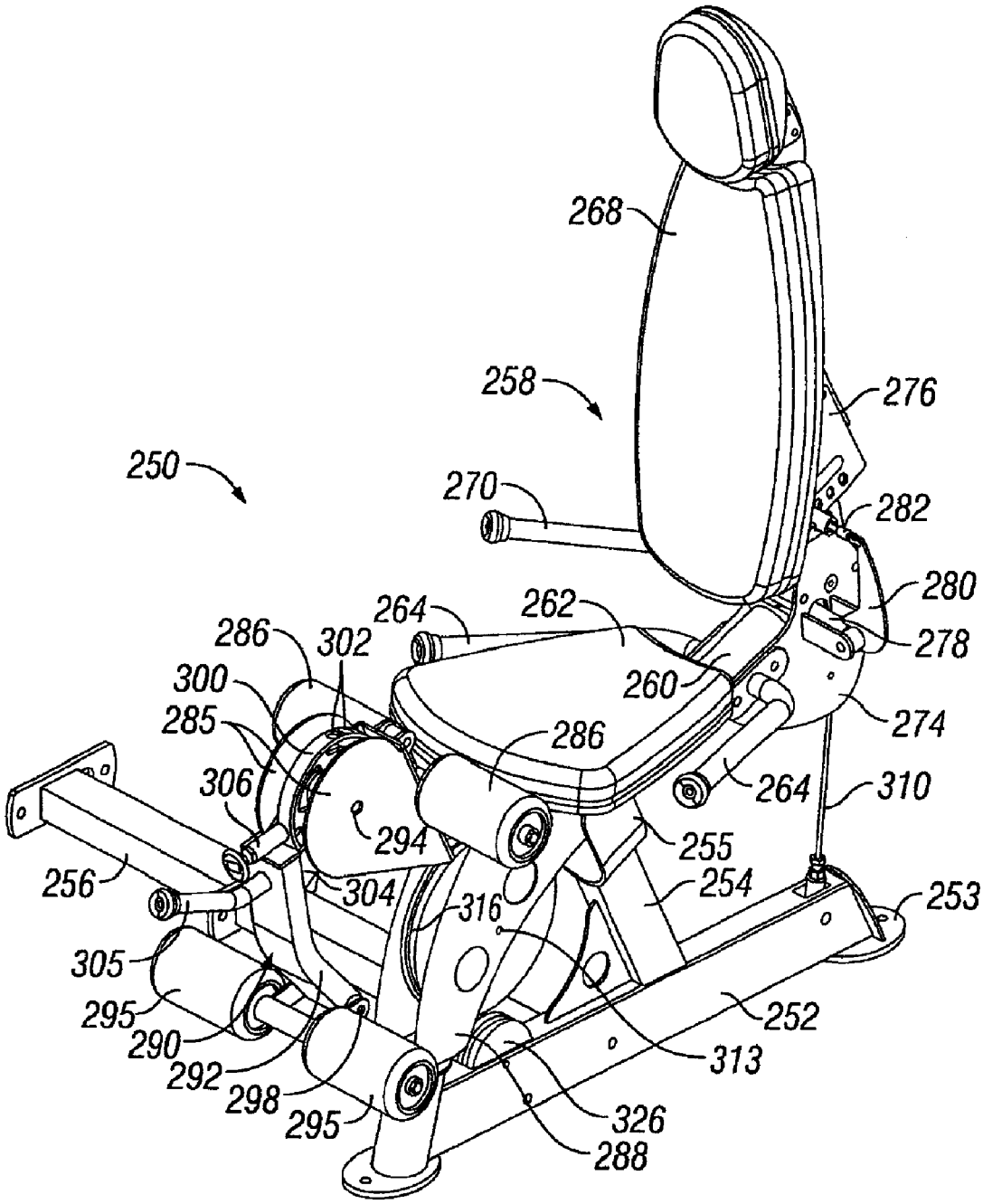
FIG. 6 is a front perspective view of a combination leg extension/leg curl exercise machine according to another embodiment.

The adjustable mounting of the back rest frame allows adjustment of the back pad orientation and position for various size users. Adjustment handle 270 allows the user to adjust the back pad position via a range-of-motion (ROM) adjuster mechanism 272 between the seat frame and back rest frame, similar to the adjuster mechanisms in the previous embodiments. ROM adjuster mechanism 272 is illustrated in FIGS. 6 and 7 and includes a pair of adjuster brackets 274 secured to the rear end of the seat support tube 260 and a ROM adjuster housing 275 at the lower end of back rest frame 265. Linkage bars 266 are pivotally secured between adjuster brackets 274 at their lower ends and between opposite sides of housing 275 at their upper ends. A range-of-motion adjuster plate 276 is fixedly attached to one face of the adjuster housing (see FIGS. 6, 10 and 11). Adjustment handle 270 has a bent shaft 278 extending through a hole in one of the adjuster brackets and is pivotally mounted to the other adjuster bracket. The shaft 278 is linked via a pull pin linkage 280 to a pull pin 282 mounted on the ROM adjuster plate 276. The pull pin 282 engages with an aligned hole in the range-of-motion plate 276 mounted on the ROM adjuster housing to provide positioning adjustment for the back pad to accommodate various size users. Release of the pull pin by pulling up on handle 270 allows the angle of the back rest to be adjusted. The handle is released when the desired orientation is reached, and the pull pin then springs back into an aligned ROM plate opening. A gas-assist return shock device 284 extends between adjuster bracket 274 and the adjuster housing to return the back rest to a forward position when released.

Figure 10A:
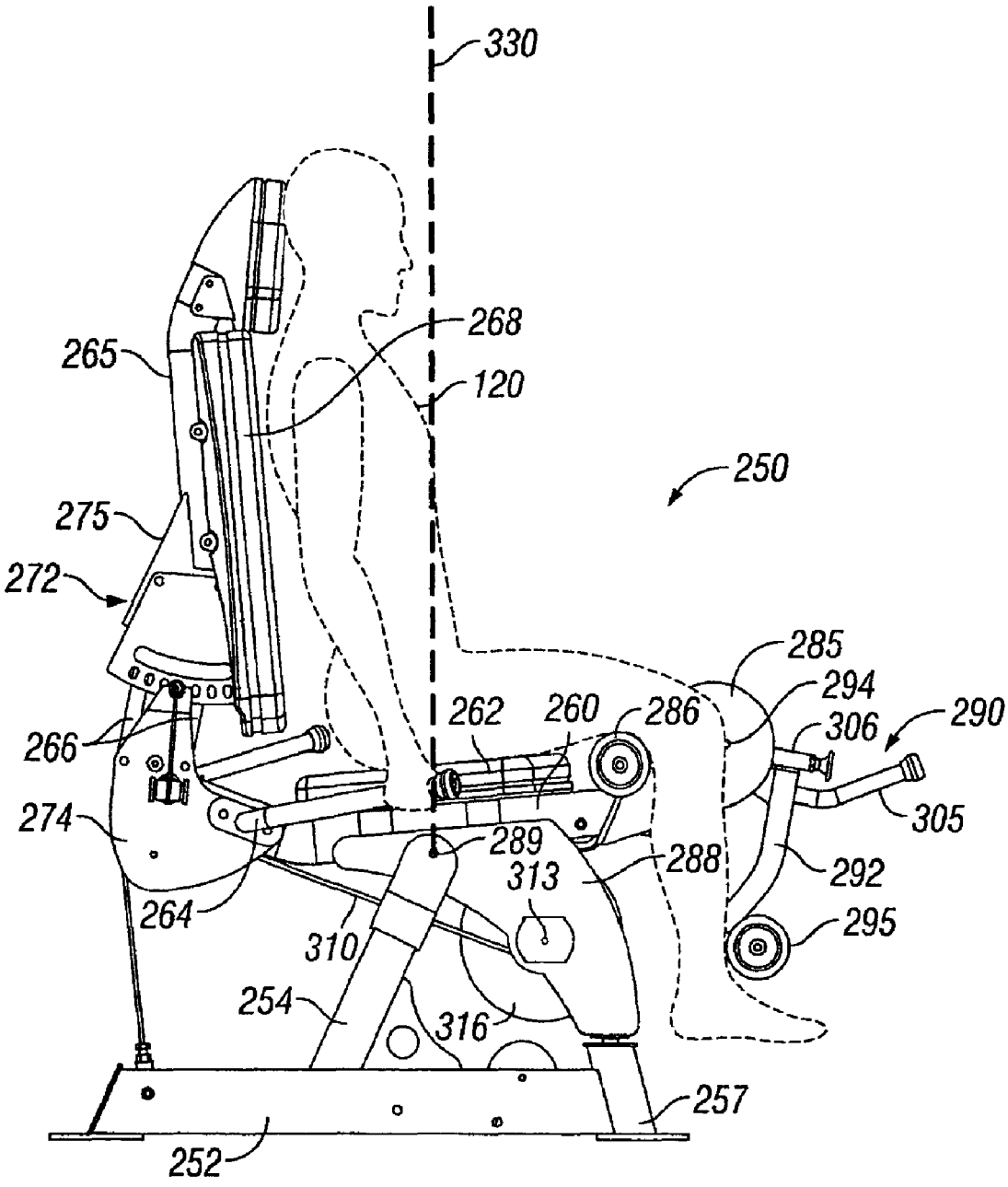
FIG. 10A is a side elevation view illustrating the machine of FIGS. 6 to 9 in a start position for a leg extension exercise, with a user seated on the machine and ready to perform the exercise.
Figure 10B:
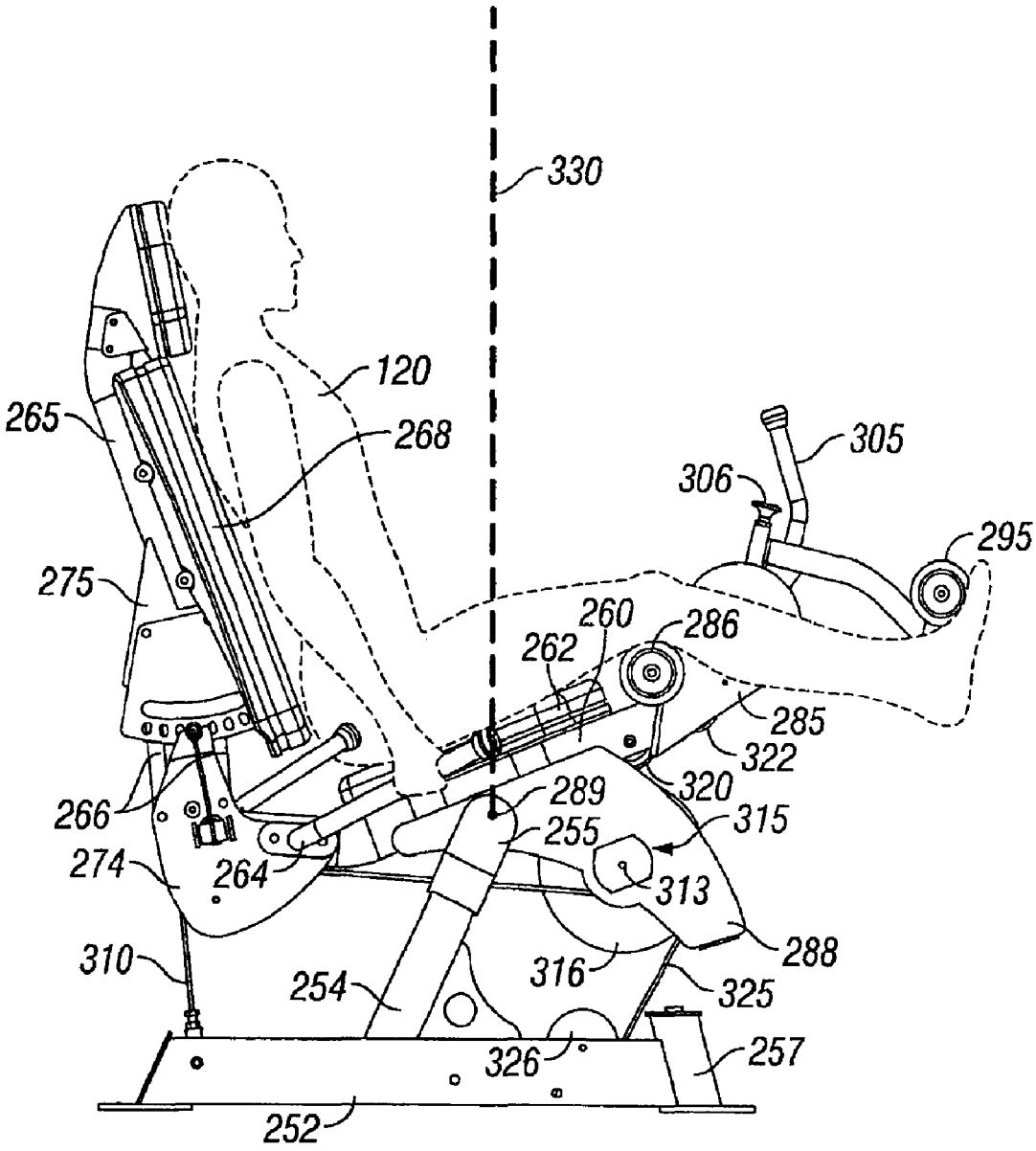
FIG. 10B is a side elevation view similar to FIG. 10A but illustrating a finish position for the leg extension exercise.

The adjuster handle 270 and associated structure may be custom designed for either left or right handed users, as illustrated in the drawings. In FIGS. 6 to 9, 11A and 11B, handle 270 is on the right hand side of the seat for convenient use by right hand users, while FIGS. 10A and 10B illustrate a variation in which handle 270 is on the left hand side of the seat for left hand users, and the remainder of the adjustment mechanism on the rear of the seat is similarly reversed. The exercise machine in these figures is otherwise identical to that of FIGS. 6 to 9, 11A and 11B.

Figure 11A:
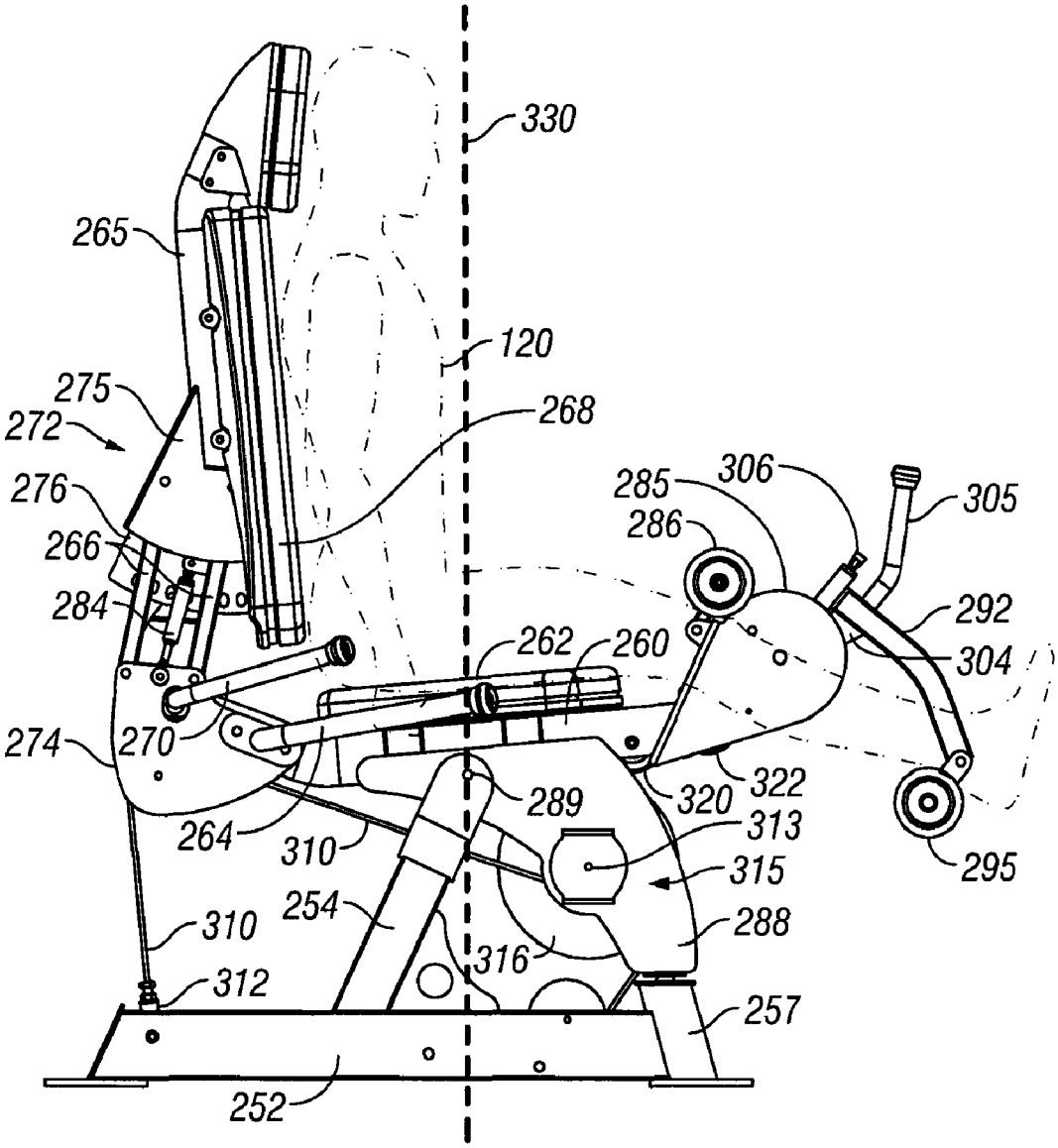
FIG. 11A is a side elevation view illustrating the machine of FIGS. 6 to 9 in a start position for a leg curl exercise, with a user seated on the machine and ready to perform the exercise.

U-shaped pivot bracket 285 is attached approximate the forward end of the seat support tube 260, and a pair of thigh brace pads or rollers 286 are pivotally attached to the rear side of pivot bracket 285. A pair of large mounting plates 288 is mounted on the underside of seat support tube 260. The seat support tube 260 is pivotally attached to main frame pivot mount 255 for rotation about user support pivot axis 289, the user support pivot mount being housed between the rear ends of mounting plates 288, as seen in FIG. 10A. Mounting plates 288 engage a bumper pad on the end of post 257 on the main frame in the rest or exercise start position, as illustrated in FIGS. 7, 10A and 11A.

The exercise arm assembly 290 comprises a main tube 292 which is pivotally mounted at one end between pivot brackets 285 for rotation about pivot axis 294, and user engaging rollers or pads 295 pivotally mounted approximate the other end of tube 292 for rotation about pivot axis 298 (see FIG. 7). The pivotal connection between the user engaging rollers and the main tube 292 enables the user engaging device to self-align to the user during the exercise and automatically adjust to the user's leg length.

A range-of-motion adjuster for the exercise arm assembly comprises a round cam 300 pivotally mounted between the user support pivot brackets 285. Cam 300 has spaced adjustment holes 302 around its circumference, for selective engagement with a pull pin or adjuster pin 306 at the end of the main tube 292 of the exercise arm assembly. Mounting brackets 304 approximate the first end of the main tube extend between the pivot brackets 285 and are pivotally mounted on the pivot pin which extends between the brackets 285. An adjuster handle 305 is attached to the main tube opposite the mounting brackets 304. The user can grip handle 305 while pulling out pull pin 306 from the ROM cam 300 and rotate the exercise arm assembly 290 to a desired position before releasing pin 306 to engage in an aligned hole 302 in the ROM adjuster. This allows the orientation of the exercise arm to be adjusted for leg extension or leg curl exercises.

The connecting linkage between the exercise arm and user support comprises a partially flexible, multiple cam linkage having a dual cam assembly 315 pivotally mounted between mounting plates 288 for rotation about pivot axis 313, a first connecting link or cable (not visible in the drawings) extending from the first cam 316 of the dual cam assembly to the exercise arm, and a second connecting link or cable 310 extending from the second cam (not visible in the drawings) of the dual cam assembly to the user support frame. This linkage translates movement of the exercise arm to movement of the user support frame. As in the previous embodiment, the first and second flexible links may comprise any suitable flexible elongate members such as cables, belts, lines, chains and the like.

The cable 310 is attached to the base section 252 of the main frame at anchor 312, reeves around a pulley 314 mounted between the adjuster brackets 274 attached to the rear of seat support tube 260 (FIG. 7), and is finally anchored to the smaller cam of the dual cam assembly 315. Cable 310 is anchored to the smaller cam of the two cams so as to wrap around the cam in a first direction. The first cable of the connecting linkage, which is not visible in the drawings, is anchored to the larger diameter cam 316 of the dual cams to wrap around the cam in a second direction opposite to the first direction, and is reeved around two pulleys 320,322 (partially visible in FIG. 10B) on the user support before anchoring to the range-of-motion cam 300 of the exercise arm, so that exercise movement of the exercise arm pulls on the first cable.

When the exercise arm is moved from the start position of FIG. 10A or FIG. 11A, the first cable of the connecting linkage is pulled, simultaneously rotating the second, smaller cam to wind cable 310 onto the second, smaller cam, pulling the user support so that it rotates rearward between the start and end positions of FIGS. 10A and 10B and FIGS. 11A and 11B. The linkage is connected to rock the user support back in the same direction regardless of the type of leg exercise performed, as explained below.

In this embodiment, exercise resistance or load is supplied by a cable and pulley system connected to a weight stack. The weight stack is not illustrated in FIGS. 6 to 11 but may be equivalent to the weight stack arrangement illustrated in the previous embodiment, but positioned to one side of the main frame in this embodiment, instead of at the forward end of the frame. The load may be positioned at the forward or rear end of the frame in other embodiments. The load supplying cable and pulley system includes a load cable 325 anchored to the large mounting plates 288 under the seat support tube 260 and extending around a pulley 326 in the base section 252 of the main frame, as illustrated in FIGS. 6 and 7. From here, the cable extends around additional pulleys and through guide tube 256 where it is linked to the weight stack in any suitable manner.

FIGS. 10A and 10B illustrate a user 120 performing a leg extension exercise on machine 250. For this exercise, the user starts with their legs bent and then extends the legs forwardly. The exercise arm must therefore be positioned in a down position for the start of this exercise, as illustrated in FIG. 10A. The user moves the exercise arm into the start position by adjusting the position of the upper end of the main tube 292 in ROM adjuster cam 300 so that the exercise arm extends downward. Thigh brace pads 286 are rotated down about pivot axis 287 into their lowermost position for a leg extension exercise.

In the start position, user 120 sits on the seat with their back against the back pad, knees bent over the thigh brace pads 286, and their feet behind the leg engaging rollers 295. They may grab the support handles 264 for additional bracing if desired. They then start the exercise movement by extending their lower legs outward. This movement causes the exercise arm to pivot about pivot axis 294 at its connection to the user support, which pulls the cable attached to the larger cam 316 of the dual cam, causing the cam to rotate and pull the second cable 310 as it wraps around the smaller cam of the dual cam. This causes the user support to pivot rearward about pivot axis 289 at its pivotal connection to the main frame. As the user support tilts rearward, lifting its front end, the load bearing cable 325 is pulled, providing resistance. FIG. 10B illustrates the finish position for a leg extension exercise. The vertical line 330 in FIGS. 10A and 10B illustrates the gravitational center line extending through the user support pivot axis 289.

Figure 11B:
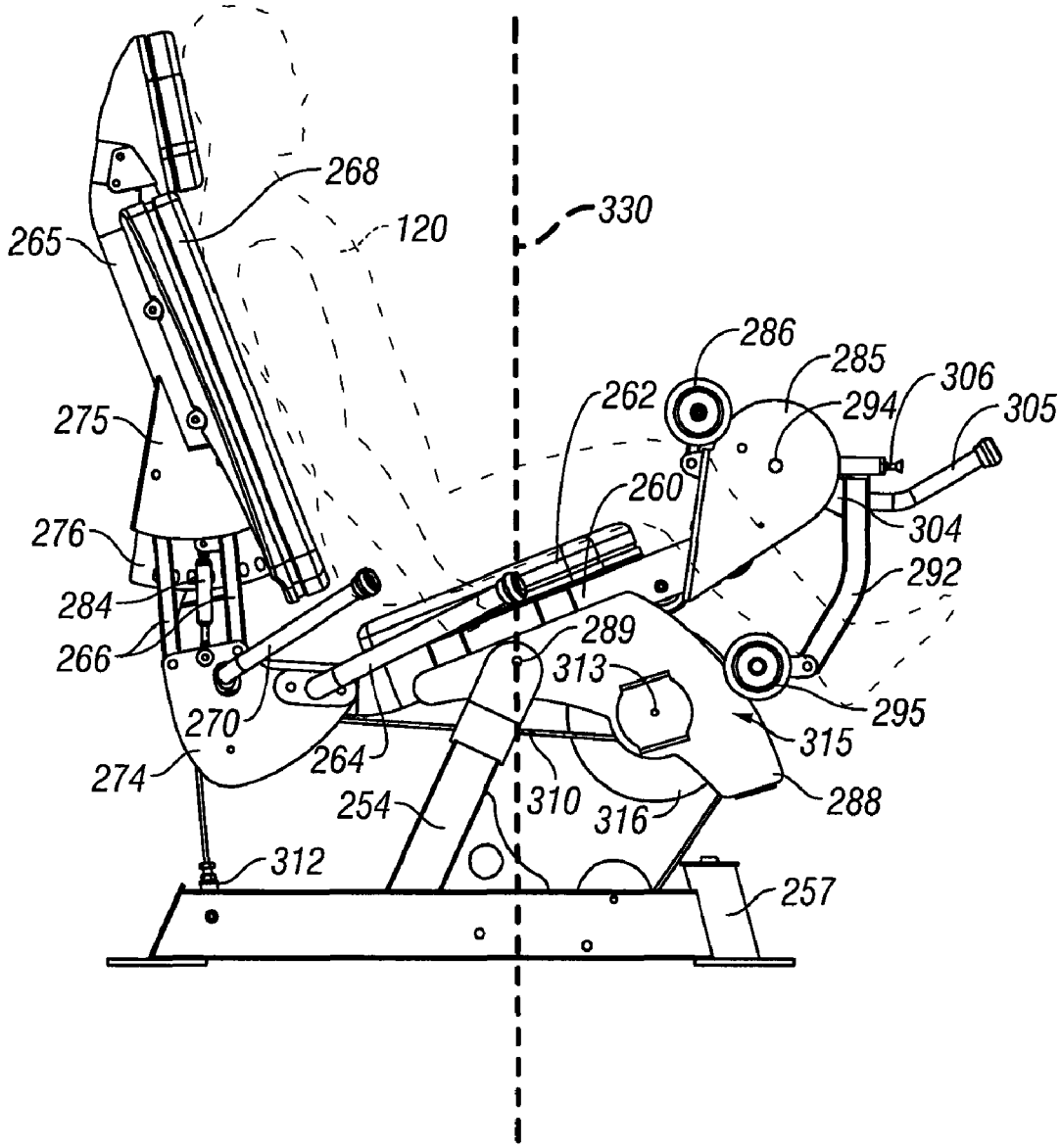
FIG. 11B is a side elevation view similar to FIG. 11A but illustrating a finish position for the leg curl exercise.

FIGS. 11A and 11B illustrate the start and finish position of a leg curl exercise on machine 250. In order to perform a leg curl exercise, the user 120 adjusts the exercise arm 290 to extend outward by pulling pull pin 306 from the aligned hole in ROM cam 300 and then pulling up on handle 305 until the exercise arm 290 is in the correct position, releasing pin 306 to extend into the aligned opening 302. The user sits on the seat pad 262 with their back against the back pad 268. The thigh brace rollers 286 are pivoted up to rest on top of the user's legs and the user's feet rest on top of the leg engaging rollers 295. The user may grab the support handles 264 for additional bracing if desired. They then start the exercise movement by curling their lower legs downward and continue to bend their legs down until the finish position is reached. This action causes the same reaction as the leg extension, pulling the cable attached to the large cam 316 of the dual cam so that the cam rotates and winds cable 310 onto the smaller cam. This in turn causes the user support to pivot back about pivot axis 289 into the reclined position of FIG. 11B.

In this embodiment, a user can selectively perform either a leg extension or a leg curl exercise. In either case, the user support moves from a relatively flat start position which is at or close to horizontal into a rearwardly inclined finish position. As in the previous embodiment, the user supporting seat and upper body support pad travel together in this embodiment, to keep the user in the same position throughout the exercise motion. The user does not have to worry about balancing on a moving platform or pad. The combined exercise arm and user support movement provides a self-aligning exercise motion that allows the user to achieve a full range of exercise motion. The user can easily switch between a leg extension and a leg curl exercise simply by releasing pull pin 306 from the ROM plate and rotating the exercise arm to the proper start position.

In each of the above embodiments, the user engagement device, which comprises a rigid exercise arm or handles attached to a flexible line, is linked to the user support so that movement of the user engagement device produces movement in the user support. The connecting linkage is a multi-part linkage which translates movement of the user engagement device to movement of the user support. In the above embodiments, the connecting linkage is a partially flexible linkage including at least one dual cam or multiple cam portions which may be of different diameter. By adjusting the ratio between the two cam diameters, the amount of movement of the user support as result of movement of the user engagement device can be varied. In both embodiments, the flexible connecting link or cable associated with the user support frame engages both the main frame and the user support, in one case extending around a pulley on the main frame, and in the other case being anchored to the main frame after extending around a pulley on the user support. In one embodiment, the user engagement device includes a flexible cable extending around pulleys on the main frame, while in the other embodiment the user engagement device is a rigid exercise arm pivotally mounted at the forward end of the user support.

In each of the above embodiments, movement of the user support is linked to movement of the exercise arm and the user support pivot or theoretical pivot is positioned so that the combined weight of the user support and user is distributed on both sides of the gravitational centerline of the pivot, and the user support provides a counter-balancing effect on the exercise arm as it moves and its weight is re-distributed. This balanced weight distribution positions a portion of the user and user support on each side of the gravitational centerline in both the start and finish positions. As the exercise arm is moved, a portion of this combined weight passes through the gravitational centerline redistributing the weight. This redistribution is gradual and continuous throughout the exercise motion and is not noticed by the user.

In the exercise machines described above, operation of the user engagement device causes a rocking movement of the user support. Due to the position of the user support pivot, the movement of the user and user support has only a small effect on the exercise resistance felt by the user, and there is no high resistance to be overcome in starting the exercise, or large resistance drop-off. The rocking movement of the user support recruits core stabilizing muscles and also makes the exercise enjoyable to perform. Repetitious exercise movement can be tedious and boring. By adding motion to the user support, without any large increase or change in resistance felt during the exercise, performing the exercise is more enjoyable and the user's interest in their workout increases. This is a benefit both to the individual exerciser, who may be motivated to exercise more regularly, and the fitness facility, where retention of members is a primary objective.

It should be understood that all the different elements used in the various embodiments may be mixed and interchanged with one another, and different types and forms of components could be used without affecting the scope of the invention. Cables could be replaced with belts, ropes, chains, or the like, and pulleys could be replaced with sprockets. The seat and/or back pad could be fixed or made adjustable. Various different types of user engaging pads can be used. The exercise arm could be unidirectional or bi-directional, may be rigid or flexible, and may be in one piece (dependent) or two pieces for independent arm movement. The exercise arm may be mounted on the user support, main frame, or connecting linkage, and the exercise arm movement may be rotational or linear. Different user engaging handles may be used, providing rigid or flexible, fixed or self-aligning, two dimensional or three dimensional hand movement, without affecting the overall function of the machines.

The user support and user engagement device could be designed to travel in the same or opposite directions. The user support pivot mount may have a single pivot or multiple pivots, and in the latter case the user support pivots about a theoretical pivot axis of the combined pivotal movement. Any of the various embodiments could have the resistance associated with any of the moving parts (user support, user engagement device, or connecting linkage). The exercise resistance may be a weight stack linked to part of the apparatus by a cable and pulley arrangement, or may be weight plates. Any other type of resistance known in the art may alternatively be used, such as hydraulic, pneumatic, electromagnetic, or elastic bands, in place of the weight stack or weight plates.

Although the exercise machines described above are single, stand-alone exercise stations, any of them may be incorporated as one of the exercise stations in a multi-station exercise machine. In each case, the multiple user support pads provide secure and safe positioning, placing the user in the proper exercise alignment from start to finish, without any adjustment required by the user. The seat and upper body support (chest pad or back pad) travel together in fixed alignment to keep the user in the same position throughout the exercise motion so that the user does not have to worry about balancing on a moving platform or pad.

In each case, the user support is positioned relatively low to the ground in the start and end position, making the machines quicker, easier, and safer to enter and exit. The user does not have to climb up or down in order to get into, or out of, the exercise position. The low profile also makes the machines more economical to produce and less intimidating to the user. The combined exercise arm and user support movement produces an automatic and continuous self-aligning exercise motion that allows enhanced hand, wrist and foot positioning versus free weight and free bar exercises or prior art machines for performing equivalents of such exercises.

Although the exercise machines described above are for performing upper back exercises or leg exercises, they may alternatively be arranged for performing different types of exercise. If the user faces in the opposite direction on the user support of FIGS. 1 to 5 and pulls the handles in the reverse of the movement of FIG. 5, i.e. from a position adjacent their body to a forwardly extended end position with their arms extending straight forward, a pec fly-like exercise may be performed. Other exercise machines with rocking seats may incorporate a connecting linkage including a dual cam as described above, such as a pull down exercise machine where the handles are positioned above the user support, a seated dip exercise machine, a shoulder press or chest press exercise machine, a leg press exercise machine, or other exercise machines, as described in co-pending application Ser. No. 10/633,805 referenced above, the contents of which are incorporated herein by reference.

The connecting linkage which links movement of the exercise arm to movement of the user support could be made adjustable. The multiple cam assembly of the connecting linkage in the above embodiments may be two cams connected together for rotation about a common cam axis, or may be a single cam with dual winding areas connected to the respective flexible links or cables so that one link or cable wraps while the other unwraps when the cam assembly rotates. The cam sizes or profiles may be changed in order to very the amount of cable pull.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. An exercise machine, comprising:

a floor-engaging main frame;

a user support frame pivotally mounted relative to the main frame for rotation about a user support pivot axis, the user support pivot axis defining a vertical, gravitational center line;

the user support frame having at least a primary support and a secondary support for supporting spaced positions on a user's body throughout an exercise movement, the secondary support being fixed at a predetermined angular orientation relative to the primary support, the primary support supporting the majority of a user's weight in the start position of the support frame;

a user engagement device movably mounted relative to the frames which is engaged by the user in performing exercises;

a connecting linkage which translates movement of the user engagement device to movement of the user support frame;

the connecting linkage having first and second cam winding portions rotatable about a common cam axis and axially spaced along the common cam axis, a first flexible link connected for winding about the first cam winding portion and a second flexible link connected for winding about the second cam winding portion; and a load for resisting movement of at least one of the user support, user engagement device, and connecting linkage.

2. The machine of claim 1, wherein the first flexible link is connected for winding in a first direction about the first cam portion and the second flexible link is connected for winding in a second, opposite direction, whereby one of the flexible links wraps while the other flexible link unwraps during an exercise movement.

3. The machine of claim 1, wherein the cam portions are of different profiles.

4. The machine of claim 1, wherein the first flexible link is associated with the user engagement device and the second flexible link is associated with the user support frame.

5. The machine of claim 4, wherein the second flexible link is also associated with the main frame.

6. The machine of claim 4, wherein the user engagement device comprises at least one user engaging handle and a flexible member extending from the handle and associated with the first flexible link of the connecting linkage.

7. The machine of claim 4, wherein the user engagement device comprises at least one exercise arm and the first flexible link is associated with the exercise arm.

8. The machine of claim 7, wherein the exercise arm is a bi-directional arm.

9. The machine of claim 1, wherein the user support pivot axis is positioned such that portions of the combined weight of the user and user support frame are distributed on each side of the gravitational center line of the user support pivot axis in at least one of the start and end position and only a portion of the combined weight passes through the gravitational center line during the exercise movement.

10. An exercise machine, comprising:

a floor-engaging main frame;

a user support frame pivotally mounted relative to the main frame;

the user support frame having at least a primary support and a secondary support for supporting spaced positions on a user's body throughout an exercise movement, the secondary support being fixed at a predetermined angular orientation relative to the primary support, the primary support supporting the majority of a user's weight in the start position of the support frame;

a user engagement device movably mounted relative to the frames for engagement by the user in performing exercises;

a multiple part connecting linkage which translates movement of the user engagement device to movement of the user support frame;

the connecting linkage having at least two axially spaced cam winding portions rotatable about a common cam axis, a first flexible elongate member connected for winding about the first cam winding portion and associated with the user engagement device, and a second flexible elongate member connected for winding about the second cam winding portion and associated with the user support frame, whereby movement of the user engagement device to perform an exercise reeves one flexible elongate member around the respective cam winding portion so that the user support frame moves from a start position to an end position; and a load for resisting movement of at least one of the user support, user engagement device, and connecting linkage.

11. The machine of claim 10, wherein the user engagement device is movably associated with the main frame.

12. The machine of claim 10, wherein the user engagement device is movably associated with the user support frame.

13. The machine of claim 10, wherein the first and second cam winding portions are of different profiles.

14. An exercise machine, comprising:

a floor-engaging main frame;

a user support frame pivotally mounted for rotation relative to the main frame;

the user support frame having at least a primary support and a secondary support for supporting spaced positions on a user's body throughout an exercise movement, the secondary support being fixed at a predetermined angular orientation relative to the primary support, the primary support supporting the majority of a user's weight in the start position of the support frame;

a user engagement device movably associated with at least one of the frames and engaged by the user in performing exercises;

an at least partially flexible connecting linkage which translates movement of the user engagement device to rotational movement of the user support frame, the connecting linkage including at least one cam; and a load for resisting movement of at least one of the user support, user engagement device, and connecting linkage.

15. The machine as claimed in claim 14, wherein the user engagement device comprises at least one rigid exercise arm.

16. The machine as claimed in claim 15, wherein the exercise arm is bi-directional and moves in a first direction to perform a first exercise and in a second direction to perform a second, different exercise.

17. The machine as claimed in claim 14, wherein the user engagement device comprises at least one flexible exercise arm.

18. The machine as claimed in claim 14, wherein the user support frame supports a user in a seated position and the user engagement device has handles for gripping and moving by a user to perform an upper back exercise.

19. The machine as claimed in claim 14, wherein the user support frame supports a user in a seated position and the user engagement device comprises a leg exercise arm engaged by a user to perform a leg exercise.

20. An exercise machine, comprising:

a floor-engaging main frame;

a user support frame;

a pivot assembly pivotally mounting the user support frame which allows rotation of the user support frame relative to the main frame between a start position and an end position, the pivot assembly having at least one pivot and defining a vertical gravitational center line of the pivotal movement of the user support frame;

the user support frame having at least a primary support and a secondary support for supporting spaced positions on a user's body throughout an exercise movement, the secondary support being fixed at a predetermined angular orientation relative to the primary support, the primary support supporting the majority of a user's weight in the start position of the support frame;

a user engagement device movably mounted relative to the frames and engaged by the user in performing exercises;

an at least partially flexible connecting linkage which translates movement of the user engagement device to rotational movement of the user support frame, the connecting linkage comprising at least one cam device mounted for rotation about a cam axis and having at least a first winding portion and at least a first flexible link associated with the cam winding portion; and a load for resisting movement of at least one of the user support, user engagement device, and connecting linkage.

21. The machine as claimed in claim 20, wherein the cam device has a second winding portion axially spaced from the first winding portion, and a second flexible link associated with the second winding portion.

22. The machine as claimed in claim 21, wherein the first flexible link is associated with the user engagement device and the second flexible link is associated with the user support frame.

23. The machine as claimed in claim 20, wherein the gravitational center line of the pivot assembly is positioned such that portions of the combined weight of the user and user support frame are distributed on each side of the gravitational center line in at least one of the start and end positions.

24. The machine as claimed in claim 20, wherein the user engagement device has a pair of handles which are gripped by a user when performing an exercise.

25. The machine as claimed in claim 24, wherein the user engagement device further comprises first and second link portions extending from respective handles and associated with the flexible connecting linkage.

* * * * *